United States Patent [19]

Lauer

[11] 4,319,716

[45] Mar. 16, 1982

[54] PIEZOELECTRIC FLUID ATOMIZER

[75] Inventor: Reinhard Lauer, Hamburg, Fed. Rep. of Germany

[73] Assignee: U.S. Philips Corporation, New York, N.Y.

[21] Appl. No.: 119,910

[22] Filed: Feb. 8, 1980

[30] Foreign Application Priority Data

Feb. 9, 1979 [DE] Fed. Rep. of Germany ..... 2904861

[51] Int. Cl.[3] ..... B05B 17/06

[52] U.S. Cl. ..... 239/102; 310/323; 310/325

[58] Field of Search ..... 239/4, 102; 128/200.16; 261/DIG. 48; 310/323, 325

[56] References Cited

U.S. PATENT DOCUMENTS

| | | | |
|---|---|---|---|
| 3,400,892 | 9/1968 | Ensminger | 239/102 |
| 3,681,627 | 8/1972 | Murry et al. | 310/325 |
| 3,861,852 | 1/1975 | Berger | 310/325 X |
| 4,153,201 | 5/1979 | Berger et al. | 239/102 |
| 4,169,984 | 10/1979 | Parisi | 310/323 |

FOREIGN PATENT DOCUMENTS

| | | | |
|---|---|---|---|
| 435859 | 12/1974 | U.S.S.R. | 310/325 |
| 489533 | 2/1976 | U.S.S.R. | 239/102 |

*Primary Examiner*—Johnny D. Cherry
*Attorney, Agent, or Firm*—Marc D. Schechter

[57] ABSTRACT

A piezoelectric fluid atomizer comprises an oscillating plate which is made to resonate by means of an electric alternating voltage. The element causing the oscillations is a piezoceramic converter which is connected to the oscillating plate via a cylindrical extension part. The cylindrical extension with the oscillating plate is constructed as an axial extension of the front side of a bolt which comprises a widened portion in the form of an abutment plate adjacent the cylindrical extension. The bolt supports converter elements which are shaped as rings and which are pressed across the bolt against the abutment plate by means of a pressure plate. A shield which extends across the converter elements is secured on the bolt at some distance behind the pressure plate. In operation an oscillation node is present for the freely suspended part supporting the piezoelectric converter elements, at the area of the abutment plate. A further oscillation node is present for the freely supported part and the shield, at the area where the shield is secured to the bolt.

8 Claims, 2 Drawing Figures

PIEZOELECTRIC FLUID ATOMIZER

BACKGROUND OF THE INVENTION

The invention relates to a piezoelectric fluid atomizer comprising an oscillating plate which is made to resonate by means of an alternating electric voltage. The element which produces the oscillations is a piezoceramic converter which is connected to the oscillating plate via a cylindrical extension.

Oil-fired heating boiler systems operate uneconomically as the units become smaller, because the burner output cannot be decreased below amounts of about 2 liters per hour with known atomizing nozzles. Smaller oil flow rates would require nozzles with very small apertures which are susceptible to blockage with dirt, thus causing breakdowns.

Smaller amounts of oil or fluid can be atomized by means of a piezoelectric oscillating system as known from German Auslegeschrift No. 20 32 433 and U.S. Pat. No. 3,904,896. A piezoelectric oscillating system of this kind consists of a ceramic disc, the front side of which accommodates a cylindrical extension and an oscillating plate for spraying the fluid. The fluid is applied to the oscillating plate via the cylindrical extension.

It has been found that piezoelectric oscillating systems of this kind are vulnerable to mechanical problems and offer only mediocre efficiency.

SUMMARY OF THE INVENTION

An object of the invention is to provide a piezoelectric fluid atomizer which is mechanically stable and which offers good efficiency.

In a piezoelectric fluid atomizer of the kind described above, this object is realized according to the invention in that the cylindrical extension with the oscillating plate is constructed as an axial extension of the front side of a bolt.

The bolt is provided, adjacent the cylindrical extension, with a widened portion which serves as an abutment plate. On the bolt there are provided piezoelectric converter elements in the form of rings which are slidably arranged on the bolt and are pressed against the abutment plate by way of a pressure plate. On the bolt there is secured, at some distance behind the pressure plate, a shield which encloses the converter elements. An oscillation node is present, for the freely suspended part which supports the piezoelectric converter elements, at the area of the abutment plate. A further oscillation node is present, for the freely suspended part and the shield, at the area where the shield is secured to the bolt.

A piezoelectric fluid atomizer of this kind is mechanically stable because it is assembled on the bolt. The bolt extends through the annular converter elements as far as the rear connection to the nozzle block. The insusceptibility to mechanical damage results from the introduction of an additional oscillation node for the complete atomizer at the area of its mount.

In a further embodiment according to the invention, the diameter of the bolt is reduced at the area of the converter elements. To this end, in an embodiment of the bolt in the form of a threaded bolt, the thread is removed as far as the core of the bolt at the area of the converter elements. As a result of this reduction of the diameter, the efficiency of the atomizer is increased. This is because its elasticity is increased at the area of the converter elements. Moreover, the mechanical strength is increased. This results from the fact that during assembly and in the oscillating condition a torsional stress occurs in the thread which is no longer present when the thread is removed.

Because the bolt is threaded, the pressure plate which presses the converter elements against the abutment plate may be constructed as a nut.

Moreover, in a further embodiment according to the invention, the shield is secured on the threaded bolt by means of a nut which at the same time comprises a threaded portion for screwing the atomizer to the nozzle-block. The complete atomizer can thus be assembled on the bolt by screwing, so that it is mechanically stable and easy to mount.

In a further embodiment according to the invention, a hole is drilled into the bolt as far as the oscillating plate, a supply tube for atomizing fluid being inserted into the rear end, of the bolt, this tube extending through the threaded portion as far as a connection duct.

An embodiment according to the invention will be described in detail hereinafter with reference to the accompanying drawing.

DESCRIPTION OF THE PREFERRED EMBODIMENTS

Figure 1:
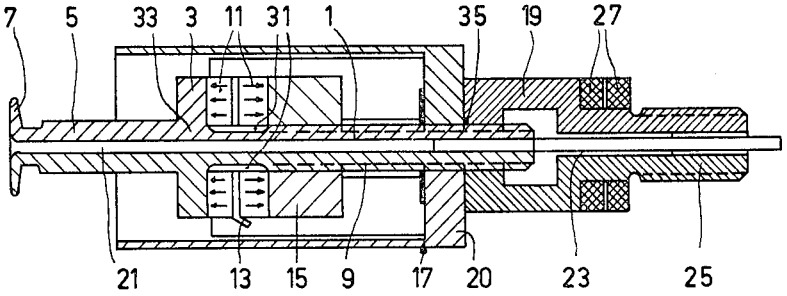
FIG. 1 is a sectional view of the atomizer.

The atomizer according to the invention is assembled on a threaded bolt 1. An abutment plate 3, a cylindrical extension 5 and an oscillating plate 7 are integral with the threaded bolt 1. The parts 1 to 7 are preferably machined from a solid material. On the thread part 9 of the bolt 1 two piezoceramic rings 11 (piezoceramic converter elements) which serve as oscillating plates are arranged. Between the piezoceramic rings 11 there is arranged an annular copper beryllium electrode 13.

The rings 11 and the electrode 13 are pressed against the abutment plate 3 by means of a nut 15.

On the rear end of the bolt 1 a shield 17 is screwed at a given distance behind the nut 15. A nut 19 secures the shield 17 on the bolt 1. Nut 19 and rear part 20 of the shield 17 form the mount of the shield.

The bolt 1 has a continuous bore 21 in which a tube 23 is inserted and soldered or welded thereto. The tube 23 projects outwards through a threaded portion 25. The threaded portion 25 is integral with the nut 19 and serves for screwing the atomizer to the nozzle block. On the threaded portion 25 there are arranged two insulating rings 27 for sealing purposes.

At the area of the piezoceramic rings 11, the threaded bolt 1 has a reduced diameter which is denoted by the reference numeral 31. This diameter reduction is obtained by removal of the thread at the area of the rings 11.

In operation, atomizer has two oscillation nodes. One node (33) is situated at the area of the abutment plate 3. The second oscillation node 35 is situated at the area of the mount of the shield 17 on the bolt 1. In order to obtain optimum uncoupling of the nodes 33 and 35, the bolt 1 supporting the piezoceramic rings, the cylindrical extension and the oscillating plate should be as thin as possible.

Figure 2:
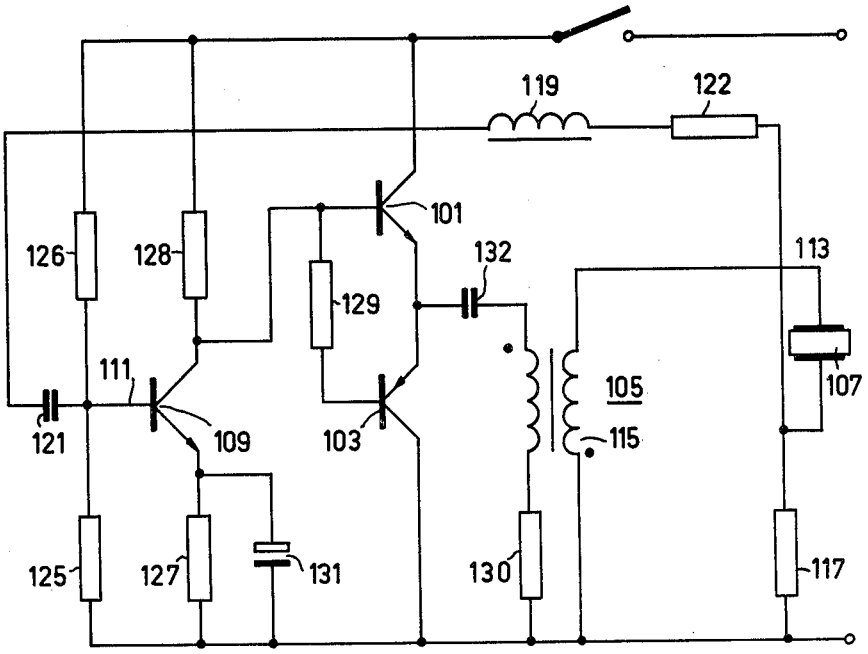
FIG. 2 shows a circuit of the atomizer-oscillator.

The oscillator circuit shown in FIG. 2 serves to ensure that the atomizer oscillates with the highest possible amplitude at its operating frequency. The atomizer may be considered as a complex dipole which has, in addition to the resonant point for atomizing, undesirable resonances of usually higher frequency. The circuit is designed so that the frequency at which the atomizer impedance is real is the operating frequency. This means that the current and the voltage at the converter are in phase. Undesired resonant points are suppressed by means of a bandpass filter in the feedback line. The feedback voltage increases as the current through the atomizer increases.

In order to satisfy these conditions, the circuit arrangement consists of a power amplifier stage with two complementary power transistors 101 and 103 which drive the atomizer 107, via a transformer 105, with a squarewave alternating voltage. The output resistance of the circuit arrangement is so low that it serves as a constant voltage source. The amplitude of the alternating voltage across the converter is dependent on (a) the d.c. supply voltage for the circuit, and (b) the transformation ratio of the transformer.

The power amplifier stage is driven by a driving transistor 109 in emitter connection. The transistors 101 and 103 are used as switches in this respect. The base 111 of the driver transistor 109 receives a feedback voltage via a lead 113. The feedback voltage is derived from the secondary circuit 115 of the transformer 105, that is to say as a voltage drop across a resistor 117 which is very small with respect to the electrical resistance of the atomizer dipole. The feedback voltage, therefore, is a measure of the alternating current through the atomizer dipole. A damped series resonant circuit 119 (an inductance in series with a capacitor 121 and a resistor 122) in the feedback line 113 acts as a bandpass filter for suppressing undesired additional resonances.

The current consumption and hence the mechanical deflection of the atomizer can be influenced by detuning the resonant circuit 119, 121, 122.

As a result of the constant voltage, the overall current consumption of the oscillator circuit is a measure of the operating condition of the atomizer. It can be used, for example, for controlling a valve.

The values of the components of the embodiment of the circuit shown in FIG. 2 are as follows:

| | | | |
|---|---|---|---|
| 117: | 10 Ω: 0.5 | 127: | 270 Ω |
| 119: | 9 mH | 128: | 3.3 k Ω |
| 121: | 1 nF | 129: | 3.3 k Ω |
| 122: | 330 Ω | 130: | 1 Ω; 1 W |
| 125: | 1 k Ω | 131: | 1 μF |
| 126 | 18 k Ω | 132: | 1.5 μF |

What is claimed is:

1. A piezoelectric fluid atomizer comprising:

a bolt having first and second ends, the first end forming an abutment plate, a cylindrical extension from the abutment plate, and an oscillating plate on the end of the cylindrical extension remote from the abutment plate;

a pressure plate secured to the bolt near its second end;

a ring-shaped piezoceramic converter element slidably mounted on the bolt and compressed between the abutment plate and the pressure plate; and a shield, secured to the bolt between the pressure plate and the second end of the bolt, said shield enclosing the converter element;

wherein when a suitable alternating voltage is applied to the piezoceramic converter element, the oscillating plate oscillates and oscillation nodes are present at the abutment plate and at the location where the shield is secured to the bolt.

2. A piezoelectric fluid atomizer as claimed in claim 1, characterized in that at the area of the piezoceramic converter element, the diameter of the bolt is reduced.

3. A piezoelectric fluid atomizer comprising:

a bolt having first and second ends, the first end forming an abutment plate, a cylindrical extension from the abutment plate, and an oscillating plate on the end of the cylindrical extension remote from the abutment plate;

a pressure plate secured to the bolt near its second end;

a ring-shaped piezoceramic converter element slidably mounted on the bolt and compressed between the abutment plate and the pressure plate; and a shield, secured to the bolt between the pressure plate and the second end of the bolt, said shield enclosing the converter element;

wherein when a suitable alternating voltage is applied to the piezoceramic converter element, the oscillating plate oscillates and oscillation nodes are present at the abutment plate and at the location where the shield is secured to the bolt; and characterized in that the bolt has threads on and near its second end.

4. A piezoelectric fluid atomizer as claimed in claim 3, characterized in that at the area of the piezoceramic converter element, the diameter of the bolt is reduced.

5. A piezoelectric fluid atomizer as claimed in claim 4, characterized in that there is no thread at the area of the piezoceramic converter element.

6. A piezoelectric fluid atomizer as claimed in claim 5, characterized in that the pressure plate is a nut.

7. A piezoelectric fluid atomizer as claimed in claim 6, characterized in that the shield is secured to the bolt by a second nut, and the second nut has a threaded portion for securing it to an external base.

8. A piezoelectric fluid atomizer as claimed in claim 7, characterized in that the bolt has a bore which extends therethrough from the second end to the oscillating plate.

* * * * *